US008919939B2

(12) United States Patent
Paschkewitz et al.

(10) Patent No.: US 8,919,939 B2
(45) Date of Patent: Dec. 30, 2014

(54) OBJECT SEPARATOR FOR INK JET PRINTER APPLICATIONS

(71) Applicant: Palo Alto Research Center Incorporated, Palo Alto, CA (US)

(72) Inventors: John S. Paschkewitz, San Carlos, CA (US); Eric J. Shrader, Belmont, CA (US); Daniel L. Larner, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 13/965,980

(22) Filed: Aug. 13, 2013

(65) Prior Publication Data

US 2013/0342619 A1 Dec. 26, 2013

Related U.S. Application Data

(62) Division of application No. 13/335,319, filed on Dec. 22, 2011, now Pat. No. 8,506,065.

(51) Int. Cl.

| | |
|---|---|
| ***B41J 2/19*** | (2006.01) |
| ***B41J 2/175*** | (2006.01) |
| ***B41J 2/20*** | (2006.01) |

(52) U.S. Cl.

CPC ..... *B41J 2/19* (2013.01); *B41J 2/17593* (2013.01); *B41J 2/20* (2013.01)

USPC ..... 347/92; 347/85

(58) Field of Classification Search

USPC ..... 347/85, 92; 55/338, 419, 424, 447, 448, 55/459.3, 461; 96/206, 208; 209/715, 717, 209/725; 210/188, 512.1

See application file for complete search history.

(56) References Cited

U.S. PATENT DOCUMENTS

| | | | |
|---|---|---|---|
| 4,622,051 | A | 11/1986 | Polach et al. |
| 5,123,939 | A | 6/1992 | Morin et al. |
| 5,950,403 | A | 9/1999 | Yamaguchi et al. |
| 5,965,021 | A | 10/1999 | Hesse et al. |
| 6,478,415 | B2 | 11/2002 | Barinaga et al. |

(Continued)

FOREIGN PATENT DOCUMENTS

| | | |
|---|---|---|
| EP | 1844801 | 7/2009 |

OTHER PUBLICATIONS

Schoenburg et al., "The dynamic air bubble trap reduces cerebral microembolism during cardiopulmonary bypass", The Journal of Thoracic and Cardiovascular Surgery, 2003; 126:1455-1460.

(Continued)

*Primary Examiner* — Anh T. N. Vo

(74) *Attorney, Agent, or Firm* — Hollingsworth Davis, LLC

(57) ABSTRACT

Approaches to remove objects from ink in an ink jet printer are described. An object separator for an ink jet printer includes one or more inlets configured to allow passage of ink that includes objects such as bubbles and particles into the object separator. The object separator has a number of stacked plates. Some of the plates have curved channels which are connected through other plates that include vias. The plates are arranged to form at least one cyclonic flow generator, the cyclonic flow generator configured to focus the objects into one or more focused flow streams. The object separator includes one or more object outlets that allow objects to exit the object separator and at least one ink outlet that allows the ink to exit the object separator.

24 Claims, 19 Drawing Sheets

(56) References Cited

U.S. PATENT DOCUMENTS

| | | | | |
|---|---|---|---|---|
| 6,478,962 | B1 | 11/2002 | Brockhoff et al. | |
| 6,557,990 | B2 | 5/2003 | Altendorf | |
| 8,506,065 | B2 * | 8/2013 | Paschkewitz et al. | 347/92 |

OTHER PUBLICATIONS

Nieuwstadt et al., "A Fluid Mechanics Model for an Axial Cyclone Separator", Ind. Eng. Chem. Res. 1995, 34, 3399-3404.

Meng et al., "Micropumping by Directional Growth and Hydrophobic Venting of Bubbles", Micro Electro Mechanical Systems, 2005, MEMS 2005, 18th IEEE International Conference, pp. 423-426.

Gossett et al., "Particle Focusing Mechanisms in Curving Confined Flows", Anal. Chem., 2009, 81, 8459-8465.

Meng, "Manipulation of Microscopic Gas Bubbles by Using Surface Tension: Capturing, Venting and Pumping", 2005, 121 pages.

Yi et al., "The kinematic of bend-induced missing in micro-conduits", International Journal of Heat and Fluid Flow, Vo. 24, Issue 5, Oct. 2003, 28 pages.

File History for U.S. Appl. No. 13/335,319 as retrieved from the U.S. Patent and Trademark Office PAIR System on Aug. 13, 2013, 113 pages.

* cited by examiner

OBJECT SEPARATOR FOR INK JET PRINTER APPLICATIONS

RELATED APPLICATIONS

This application is a divisional of U.S. Ser. No. 13/335,319 filed Dec. 22, 2011, now U.S. Pat. No. 8,506,065 the contents of which is incorporated herein by reference in its entirety.

FIELD

The present disclosure relates generally to methods and devices useful for ink jet printing.

SUMMARY

Embodiments discussed in the disclosure are directed to approaches used in ink jet printing. Some embodiments involve an ink jet printer subassembly that includes an object separator. The object separator has one or more inlets configured to allow passage of ink that includes objects into the object separator. The objects can comprise bubbles and/or particles. The object separator includes a plurality of stacked plates. Some of the plates have curved channels that are connected through other plates that include vias. The plurality of stacked plates are arranged to create cyclonic flow of the ink in the object separator. The cyclonic flow focuses the objects into one or more focused flow streams. One or more object outlets allow objects to exit the object separator. At least one ink outlet allows the ink to exit the object separator.

Some embodiments involve a method of making a subassembly for an ink jet printer. First plates and second plates are formed. The first plates include in-plane curved channels. The second plates include vias. The plates are arranged in a stack so that the curved channels and vias form a cyclonic flow path.

Embodiments are directed to an ink jet printer subassembly that includes an object separator. The ink jet printer subassembly includes one or more inlets configured to allow passage of ink that includes objects into the object separator. The object separator includes a channel enclosed by at least one channel wall, a cyclonic flow generator and an object extractor. The cyclonic flow generator is disposed within the channel is configured to focus the objects into a concentrated object stream. The object extractor is positioned downstream of the cyclonic flow generator and within a flow path of the concentrated object stream. At least one outlet allows the objects to exit the object separator. One or more ink outlets allow ink to exit the separator.

Some embodiments involve methods for fabricating an ink jet printer subassembly that includes an object separator. A fabrication method includes forming a cyclonic flow generator and an object extractor. The cyclonic flow generator is configured to cause vortex flow of ink containing objects, e.g., bubbles and/or particles and to focus the objects into one or more concentrated streams. When the objects comprise bubbles, the object extractor can be configured to preferentially trap bubbles. The cyclonic flow generator and object extractor are positioned within an ink flow channel so that the object extractor is downstream of the cyclonic generator and within a flow path of the concentrated object stream.

According to some embodiments, an ink jet printer may include an object separator. The ink jet printer includes a print head comprising ink jets configured to selectively eject ink toward a print medium according to predetermined pattern. A transport mechanism is configured to provide relative movement between the print medium and the print head. The ink jet printer includes an object separator which comprises a cyclonic flow generator and an object extractor. The cyclonic flow generator is configured to cause vortex flow of ink containing objects and to focus the objects into one or more concentrated streams. The object extractor is positioned downstream of the cyclonic generator and within a flow path of the concentrated bubble stream. At least one object outlet passage allows exit of the objects from the separator while one or more ink outlet passages allow the ink to exit from the separator.

Yet another embodiment is directed to an ink jet printing method. A vortex flow of ink that includes bubbles and/or particles is generated in an object separator. The vortex flow focuses the objects into one or more concentrated streams. A concentrated stream of bubbles is impinged on a bubble extractor having one or more bubble traps disposed on a surface of the bubble extractor. A substantial number of bubbles are trapped in the bubble traps. Ink is allowed to flow out of the bubble separator along an ink flow path while the bubbles are vented out of the ink flow path.

DESCRIPTION OF VARIOUS EMBODIMENTS

Figure 1:
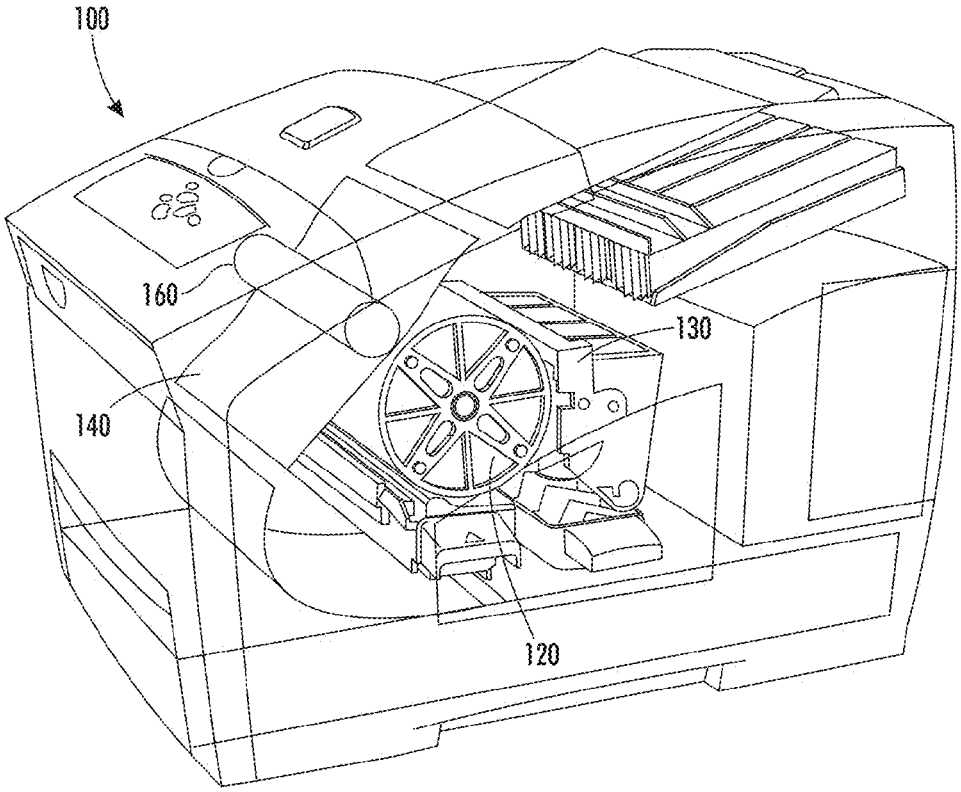
FIGS. 1 and 2 provide internal views of portions of an ink jet printer that incorporates an object separator in accordance with various embodiments.

Ink jet printers operate by ejecting small droplets of liquid ink onto print media according to a predetermined pattern. In some implementations, the ink is ejected directly on a final print medium, such as paper. In some implementations, the ink is ejected on an intermediate print medium, e.g. a print drum, and is then transferred from the intermediate print medium to the final print medium. Solid ink printers have the capability of using a phase change ink which is solid at room temperature and is melted before being jetted onto the print media surface. Inks that are solid at room temperature advantageously allow the ink to be transported and loaded into the ink jet printer in solid form, without the packaging or cartridges typically used for liquid inks.

In the liquid state, the ink may contain bubbles and/or particles that can obstruct the passages of the ink jet pathways. For example, bubbles can form in solid ink printers due to the freeze-melt cycles of the ink that occur as the ink freezes when printer is powered down and melts when the printer is powered up for use. As the ink freezes to a solid, it contracts, forming voids in the ink that are subsequently filled by air. When the solid ink melts prior to ink jetting, the air in the voids can become bubbles in the liquid ink.

Bubbles and/or particles (referred to collectively herein as "objects") in the ink jet pathways can cause misplaced, intermittent, missing or weak ink jetting resulting in undesirable visual flaws in the final printed pattern. Some ink jet printers pass the ink through filters, flow breathers, buoyancy-based bubble removers or other object removal devices to prevent bubbles and/or particles from reaching the jet region of the print head. However, these techniques present several problems. Filtering is non-optimal because filters can become clogged over the operational life of the printer. Significant engineering is required to ensure that particles and/or coalesced bubbles do not clog the filter. Additionally, filter elements block the ink flow to some extent and induce a pressure drop penalty that may be undesirable in printer operation. This pressure drop is exacerbated as the filter surface becomes covered with objects that have been filtered from the ink. Robustness of the ink jet printer subassembly can be increased by providing object removal while also mitigating the problem of filter clogging Flow breathers have been used to remove bubbles, but add complexity to the print head design. Devices that rely on the buoyancy of bubbles increase the bulk of the printer subassemblies. The characteristic rise velocities of small bubbles, i.e., on the scale of the print head orifices, are very small and the resulting times for separation of the bubbles from the ink can be large. As a result, dedicated volumes are required for the buoyancy-based bubble removal elements, increasing print head size.

Embodiments described in this disclosure involve approaches for separating objects from the ink of an ink jet printer. Some approaches involve the use of a cyclonic flow generator to produce a concentrated stream of bubbles and/or a concentrated particle stream. The concentrated bubble stream can be directed toward a bubble extractor that includes surface features to trap bubbles. The trapped bubbles can then be vented out of the ink flow path. The concentrated particle stream can be directed out of the ink flow through a particle outlet, while the cleaned ink exits the object separator through an ink outlet. The embodiments discussed herein allow the use of smaller form factor, less complex printer subassemblies by reducing the need for filtration and/or buoyancy based bubble removal features. Additionally, according to some implementations, the object separator can be formed as a layered structure, e.g., stacked plates, that simplifies fabrication of the object separator and provides compatibility with stacked plate architectures used to form other ink jet printer components.

Figure 2:
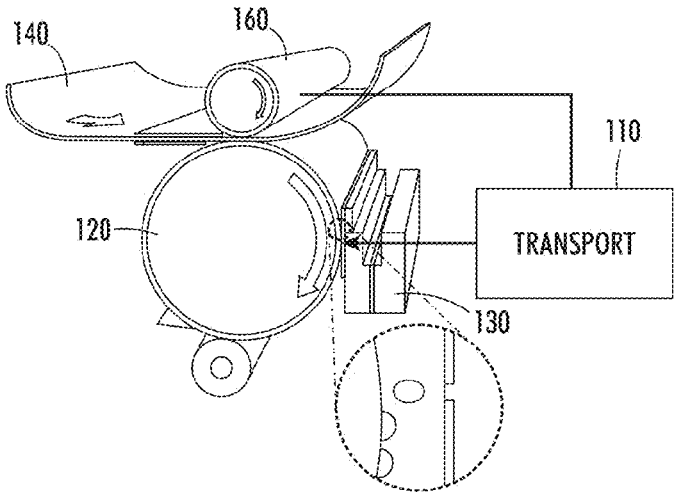

FIGS. 1 and 2 provide internal views of portions of an ink jet printer 100 that incorporates an object separator as discussed in more detail below. The printer 100 includes a transport mechanism 110 that is configured to move the drum 120 relative to the print head 130 and/or to move the print medium 140, e.g., paper, relative to the drum 120. The print head 130 may extend fully or partially along the length of the drum 120 and includes a number of ink jets. As the drum 120 is rotated by the transport mechanism 110, ink jets of the print head 130 deposit droplets of ink though ink jet apertures onto the drum 120 in the desired pattern. As the print medium 140 travels around the drum 120, the pattern of ink on the drum 120 is transferred to the print media 140. In some cases a pressure nip 160 may facilitate transfer of the ink pattern to the print medium 140.

Figure 3:
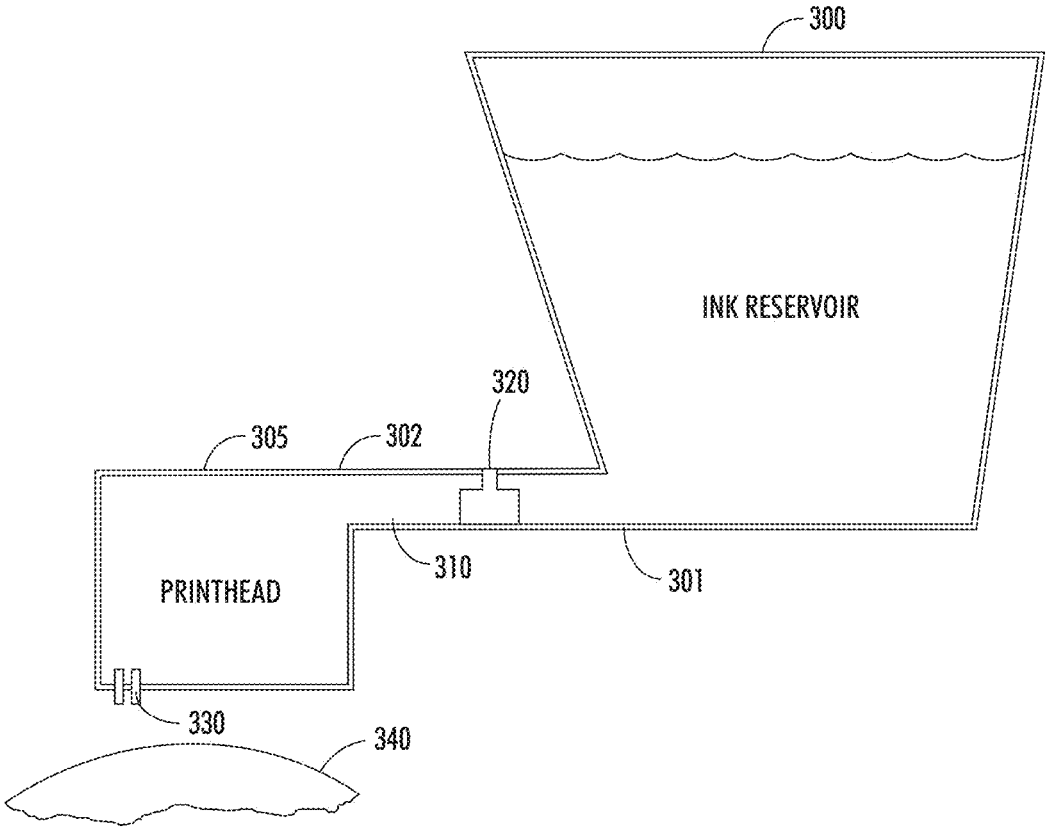
FIG. 3 illustrates a possible placement for an object separator in accordance with some embodiments disclosed herein.

FIG. 3 provides a more detailed view of possible placement locations for an object separator 320 in the ink jet printer according to various embodiments. As illustrated in FIG. 3, ink flows from an ink reservoir 300 to a print head 305 and is ejected from the print head 305 toward the print medium 340 through ink jets 330. One or more object separators 320 may be disposed at an outlet 302 from the ink reservoir 301 and/or at an inlet 302 to the print head 305. In some cases, as illustrated in FIG. 3, the ink reservoir 300 and print head 305 are coupled by a manifold 310. The manifold includes walls that enclose an ink flow channel. In these cases, one or more object separators 320 may be positioned at locations within the manifold 310 and/or in the printhead 305.

Figure 4:
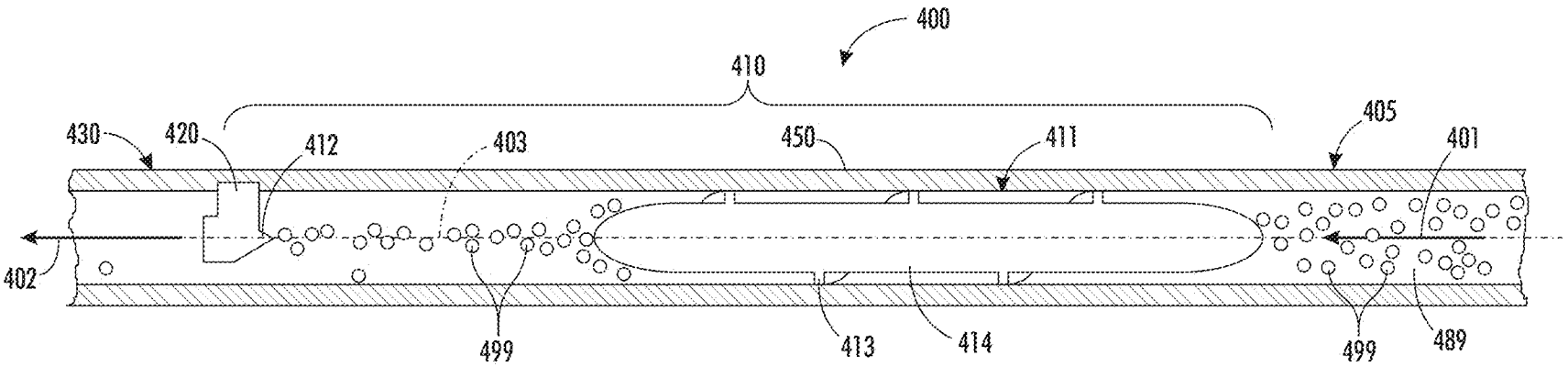
FIGS. 4 and 5 provide a cross section and an isometric view, respectively, of a subassembly that includes an object separator in accordance with some embodiments.
Figure 5:
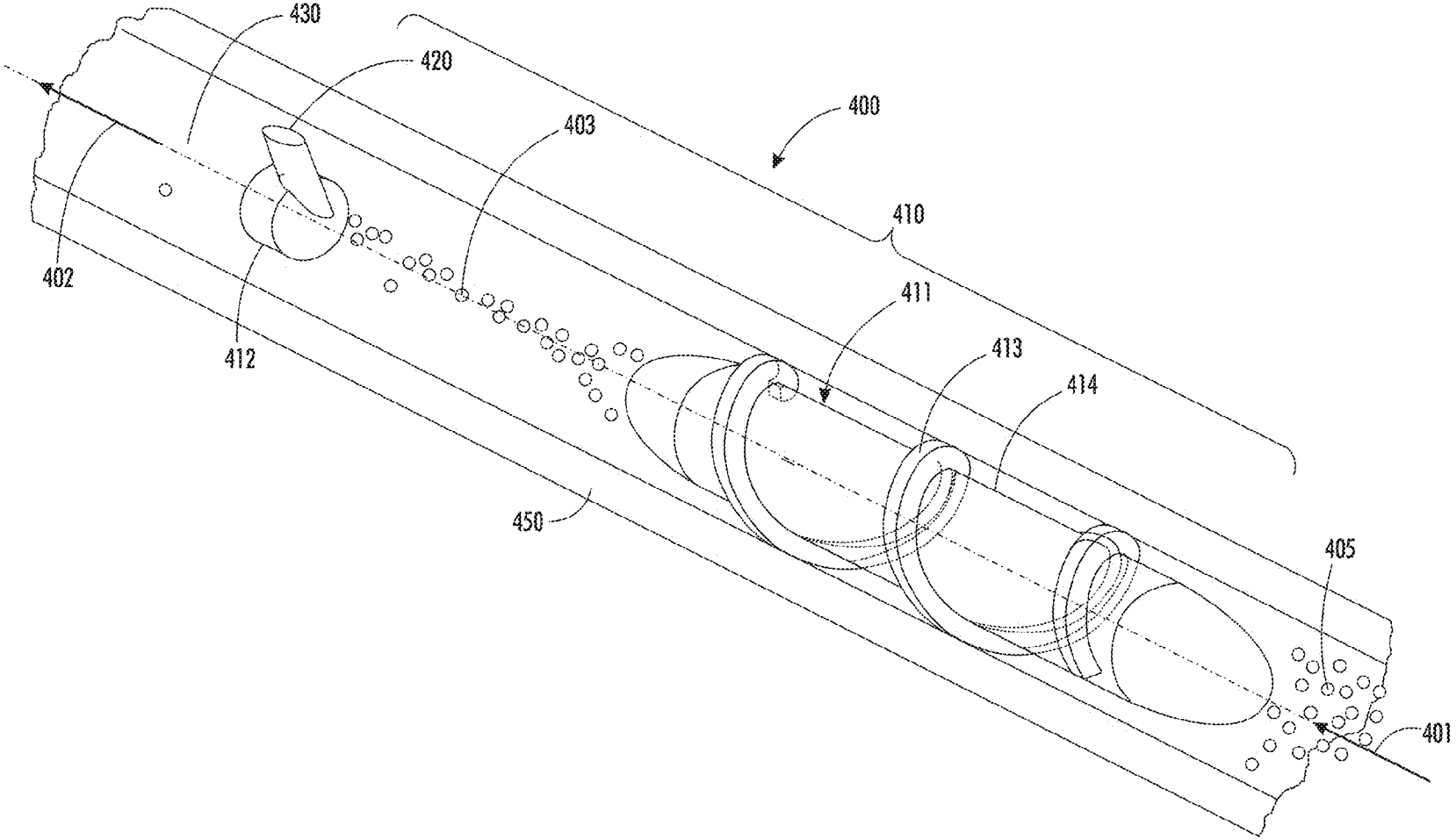

FIGS. 4 and 5 provide a cross section and an isometric view, respectively, of subassembly 400 that includes an object separator in accordance with some embodiments. Ink that contains objects, e.g., bubbles, flows along an ink flow path (indicated by arrow 401) within a channel defined by one or more channel walls 450. The ink flow path passes through an inlet 405 of the separator 410. As illustrated in FIGS. 4 and 5, objects 499 in the ink flowing into the separator 410, may be substantially randomly distributed throughout the ink in the channel. In some cases, the objects 499 may be in a size range of about 10 μm to about 100 μm, for example. The separator 410 is located within an ink flow channel enclosed by channel walls 450, e.g., formed by a conduit, tube or manifold that carries the ink. In some cases, as illustrated in FIGS. 4 and 5, the ink inlet 405 to the separator 410 may simply be a location of the manifold or tube upstream of the separator, e.g., at or just before the point at which the ink flow begins to be affected by the separator 410.

The separator 410 includes at least one focusing element 411 that is configured to focus objects, such as bubbles, into a concentrated stream 403. For example, in some implementations, as depicted in FIGS. 4 and 5, the focusing element 411 may be a cyclonic flow generator that is configured to create a vortex in the ink flow that has a radial direction in the downstream direction of the ink flow path. The vortex created by the cyclonic flow generator 411 serves to focus the bubbles in the ink into the concentrated bubble stream 403 which may be located, for example, near the centerline of the vortex. If particles are present in the ink, the vortex created by the cyclonic flow generator 411 may focus the particles into a concentrated particle stream (not shown in FIG. 4). The concentrated particle stream may be located, for example, near the channel walls 450.

The separator 410 may optionally include at least one bubble extractor 412 positioned downstream from the focusing element 411 and within the flow path of the concentrated bubble stream 403. The bubble extractor 412 is positioned so that a substantial number, e.g., more than 25% or a majority, i.e., more than 50%, or substantial majority, e.g., more than 75% of the bubbles in the concentrated bubble stream in a size (diameter) range of about 10 μm to about 100 μm impinge on the bubble extractor 412. For example, the bubble extractor 412 may be positioned at a distance from the focusing element that provides an optimal separation efficiency, $\eta_{SEP}$, as is discussed in more detail below.

The subassembly 400 includes at least one vapor outlet 420 that allows the bubbles in the concentrated bubble stream 403 and/or trapped by the bubble extractor 412 to escape from the subassembly 400. If separation of particles is also implemented, then a particle outlet may also be included. The subassembly 400 includes at least one ink outlet 430 that allows ink, which has fewer objects than the ink which entered the separator along path 401, to exit from the region of the separator 410 along ink flow path 402. In some cases, as illustrated in FIGS. 4 and 5, the ink outlet 430 may simply be a location of the manifold or tube which is downstream of the bubble separator 410, e.g., at a position of the ink flow path past the location of the bubble separator 410. As indicated by FIGS. 4 and 5, at the ink outlet 430 a substantial number, e.g., more than 25% or a majority, i.e., more than 50%, or substantial majority, e.g., more than 75% of the particles in a size range of about 10 μm to about 100 μm that were present in the ink containing objects flowing through the ink inlet 405 along ink flow path 401 have been removed from the ink flowing through the ink outlet 430 along ink flow path 402. For example, in some configurations, about 70% of the objects having diameters of about 15 μm may be removed from the ink and/or about 90% of the objects having diameters of about 25 μm may be removed from the ink.

In object separators that use a cyclonic generator as the focusing element, as depicted in FIGS. 4 and 5, the cyclonic generator 411 may include one or more features, e.g., indentations, protrusions, and/or fins, which serve to create a vortex in the ink flow that has a radial direction in the downstream direction of the ink flow. For example, at least one fin 413 may be arranged in a helix on the surface of a center element 414 of the cyclonic generator 411. Although only a single helically arranged fin is illustrated in FIGS. 4 and 5, in some cases, the cyclonic generator 411 may include multiple helical fins and/or may include other features that serve to create the radially directed vortex in the ink flow.

In addition to creating the concentrated bubble stream 403 near the centerline of the vortex generated by the cyclonic flow generator 411, particles in the ink may be forced outward from the centerline of the vortex and into a concentrated particle stream near the channel walls 450. In some embodiments, the bubbles in the concentrated bubble stream are extracted using bubble extractor 412. Additionally or alternatively, particles in the concentrated particle stream can be removed using a particle extractor. Implementations that extract both bubbles and particles are further discussed in conjunction with FIGS. 22-27 below.

Figure 6:
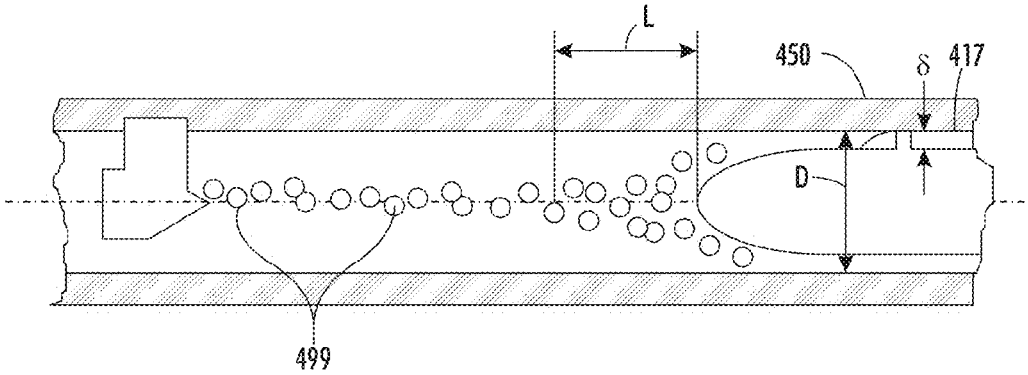
FIG. 6 depicts parameters of the separation efficiency for a cyclonic generator in accordance with various embodiments discussed herein.

Bubble removal for a cyclonic generator may be characterized by a separation efficiency, $\eta_{SEP}$, which is the ratio of the length, L, of the region downstream of the cyclonic generator that substantially focuses the bubbles to the centerline of the vortex, to the diameter of the separator section, which is the inner diameter, D, of the wall that encloses the cyclonic generator. Parameters of the separation efficiency for a cyclonic generator are depicted in FIG. 6. For a given diameter, D, a better separator requires a smaller length, L. The separation efficiency can be defined using the relationship:

$$\eta_{SEP} = \frac{L}{D} = \frac{9}{2}\pi\frac{1}{\mathrm{Re}}\frac{\rho_f}{\Delta\rho}\left(\frac{\delta}{a_p}\right)^2$$

where L is the separation length, D is the channel diameter, i.e., the inner diameter of the walls of the separation section, Re is the Reynolds number of flow in the separator section, $\rho_f$ is the density of the ink, $\Delta\rho$ is the difference between the bubble density and the ink density, which can be approximated as the ink density for ink containing bubbles, $\delta$ is the gap spacing between the outer surface 416 of the central element 414 and the inner surface 417 of the channel wall 450 that encloses the central element 414, and $\alpha_p$ is the average diameter of the bubbles 499. Note, that for a given D, shorter lengths to separate the bubble stream produce smaller values of $\eta_{SEP}$. In other words, for a given diameter, D, smaller values of $\eta_{SEP}$ represent more effective bubble separation.

Figure 7:
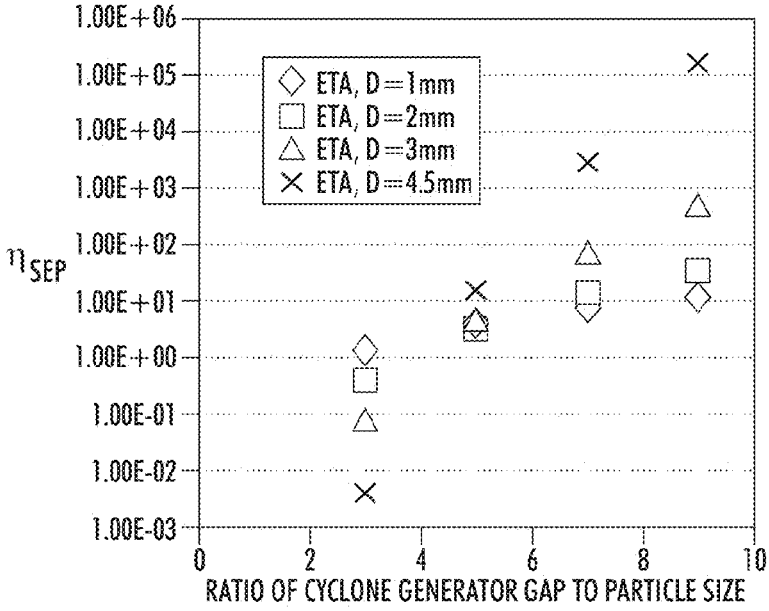
FIG. 7 provides a plot of the separation efficiency, $\eta_{SEP}$, for bubbles in ink assuming typical Reynolds number and density for ink.

A plot of the separation efficiency, $\eta_{SEP}$, for bubbles in ink is shown in FIG. 7, assuming typical Reynolds number and density for ink, and a flow rate of about 1 ml/second which approximates the flow rate of ink during a printing operation. FIG. 7 shows separation efficiency data as a function of gap size to bubble diameter ratio for various channel diameters. It will be appreciated upon review of the data presented in FIG. 7 that reasonable separation efficiency, e.g., $\eta_{SEP}$ less than about 10, can be attained using a gap to particle ratio of less than 5 for 3 mm diameter walls. For example, a separation length of about 30 mm may be achieved for a 3 mm diameter tube with a gap of 0.25 mm and bubble diameter of 50 μm. Using smaller channel diameters, for example, D equal to about 1 mm, increases the effective Reynolds number and allows the use of larger gaps, $\delta$, relative to the bubble size, while requiring a shorter separation distance, L, but also implies a larger pressure drop. Ink velocities for a volumetric flow rate of 1 ml/second range from about 1.2 meter/second at a channel diameter of 1 mm to 6 cm/second at a diameter of 4.5 mm. As depicted in FIG. 7, a separation efficiency less than or equal to about 10 can be achieved for a 1 mm diameter channel and a gap to particle size less than about 7; a 2 mm diameter channel and a gap to particle size ratio of less than about 6.8; a 3 mm diameter channel and a gap to particle size ratio of less than about 5.8; or a 4.5 mm diameter channel and a gap to particle size ratio of less than about 4.5.

Figure 8:
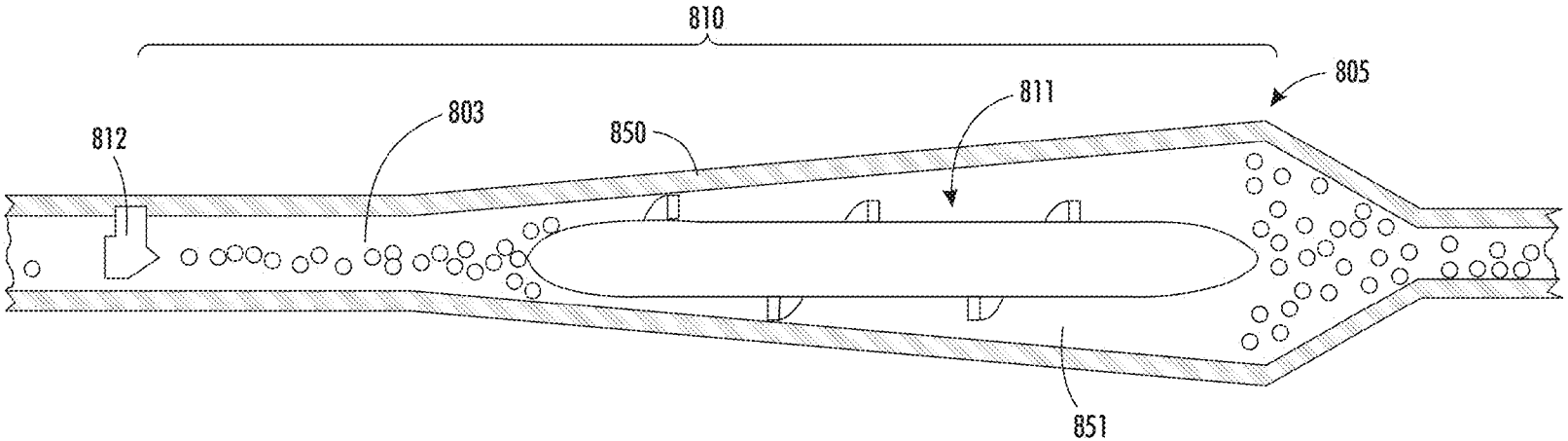
FIG. 8 illustrates an object separator having a tapered channel in accordance with some embodiments.

In some implementations, the channel wall 850 that encloses the separator channel 851 may be tapered to create a tapered channel, as depicted in the cross section diagram FIG. 8. A focusing element, e.g., cyclonic generator 811 and bubble extractor 812 are positioned within the tapered separator channel 851. For example, as depicted in FIG. 8, the separator channel 851 may be relatively wider near the ink inlet 805 and may be relatively narrower in and/or near the region of the concentrated bubble stream 803. In many cases, the slope of the walls 850 that create the tapered channel 851 is selected to enhance the creation of vortex flow. For example, in some configurations, the wall 850 may have a slope in a range from about 0 to 90 degrees or about 45 degrees.

Figure 9:
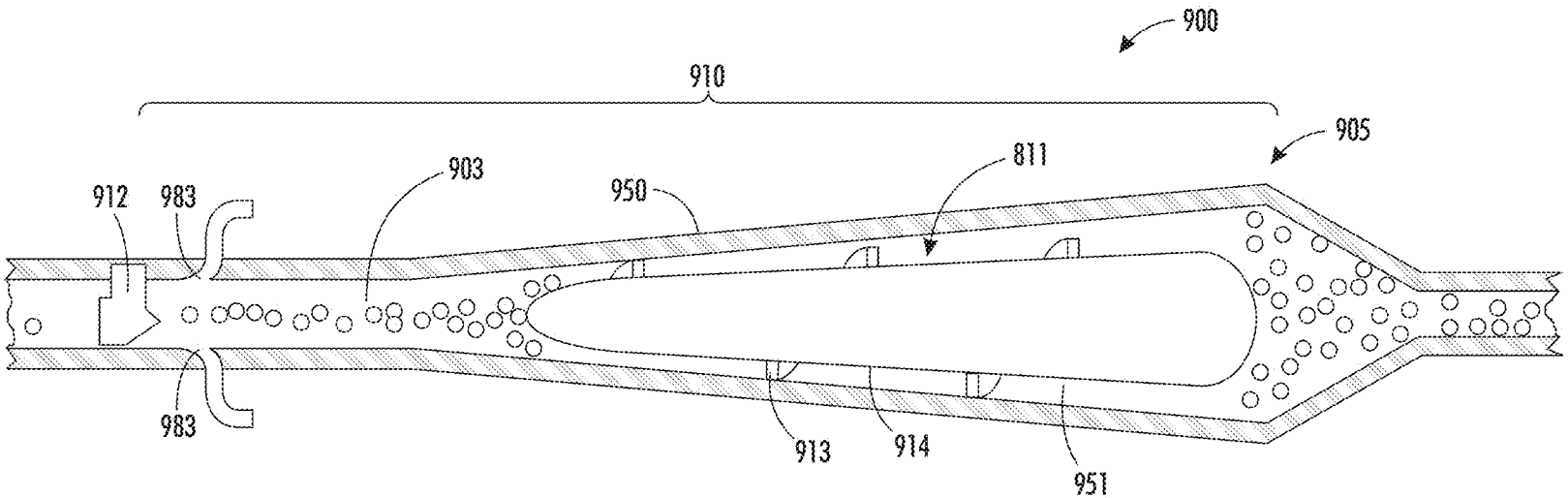
FIG. 9 illustrates an object separator having a tapered channel and having a cyclonic flow generator with a tapered body in accordance with some embodiments.

As shown in FIG. 9, in some configurations, subassembly 900 may include a separator channel wall 950 that is tapered to define a tapered channel 951 and, additionally or alternatively, the body of the focusing element 911 itself may also be tapered. For example, as depicted in FIG. 9, the separator channel 951 may be relatively wider near the ink inlet 905 and may be relatively narrower in and/or near the region of the concentrated bubble stream 903. The focusing element 911 may also be relatively wider near the ink inlet 905 and relatively narrower near the region of the concentrated bubble stream 903. When the focusing element 911 is tapered, fins 913 disposed on the surface 914 of the focusing element 911 are arranged in a tapered helix, which can be helpful in creating the vortex flow.

Note that in some implementations, the focusing element may be tapered, whereas the walls of the channel are not substantially tapered. In configurations that include tapered walls and a tapered focusing element, the slope of the wall 950 and the slope of the focusing element may be the same, or may be different. For the implementations illustrated in FIGS. 8 and 9, the tapered channel 851, 951 and/or tapered focusing element 811, 911 may achieve each some bubble stream flow focusing, thus enhancing the bubble concentration in the concentrated bubble stream 803, 903 and at the bubble extractor 812, 912. In some cases, additional flow focusing may be achieved using sheath ink that is introduced into the flow path of the ink, e.g., in the region of the concentrated bubble stream 903, through ports 983.

Figure 10:
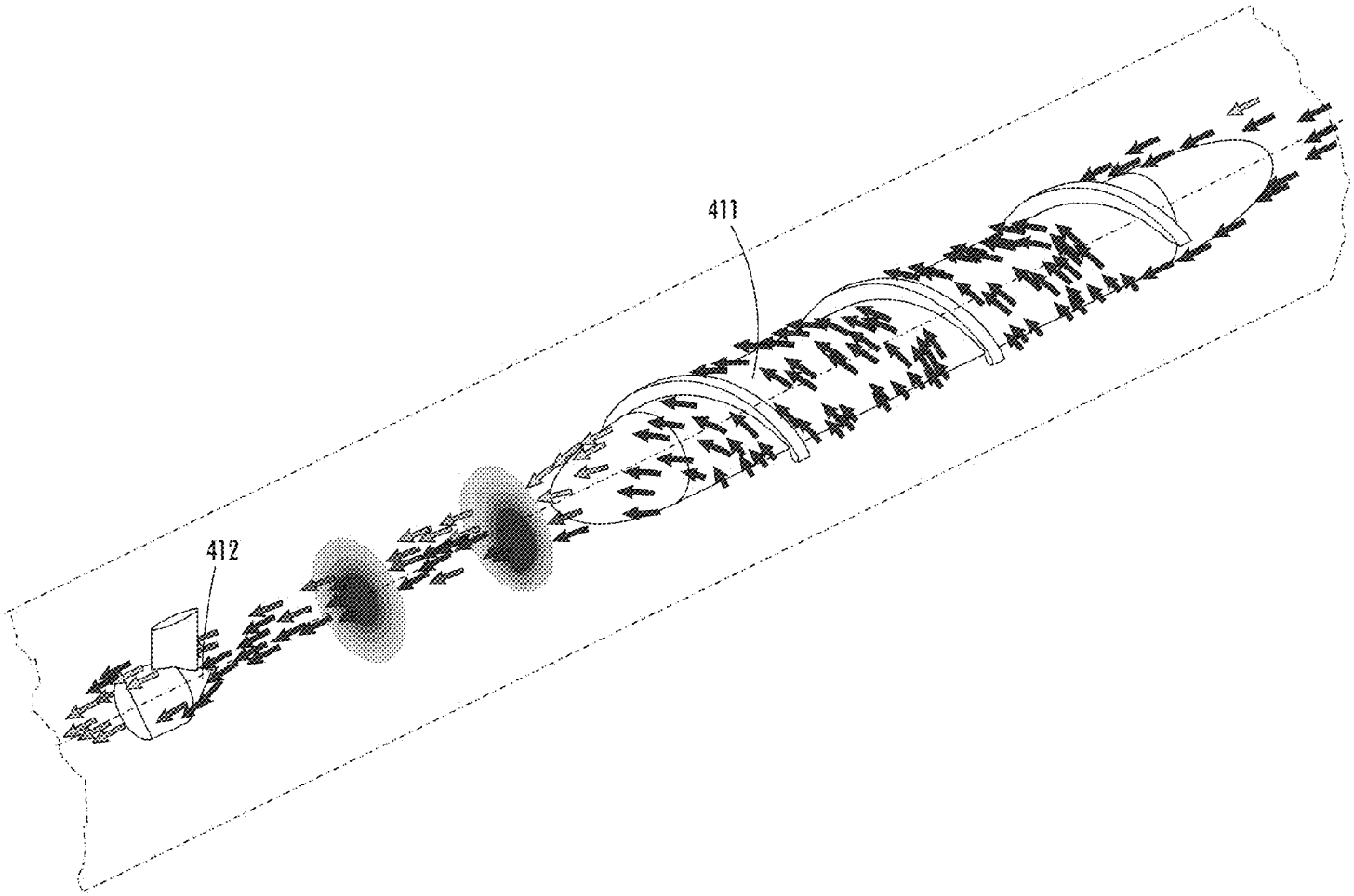
FIGS. 10 to 13 provide simulation results for the object separator embodiment depicted in FIGS. 4 and 5.

In FIGS. 10 to 13, simulation results are shown for the bubble separator depicted in FIGS. 4 and 5. In these simulations, ink properties were used and the traces show the flow paths for 50 micron bubbles. In FIG. 10, the traces (streamlines) are shown with velocity vectors in the bubble separator. As can be appreciated, the ink flow in the bubble separator is accelerated and rotated in the cyclonic generator 411 and there is a resulting accelerated vortex core region of concentrated bubble flow that impacts the bubble extractor 412.

Figure 11:
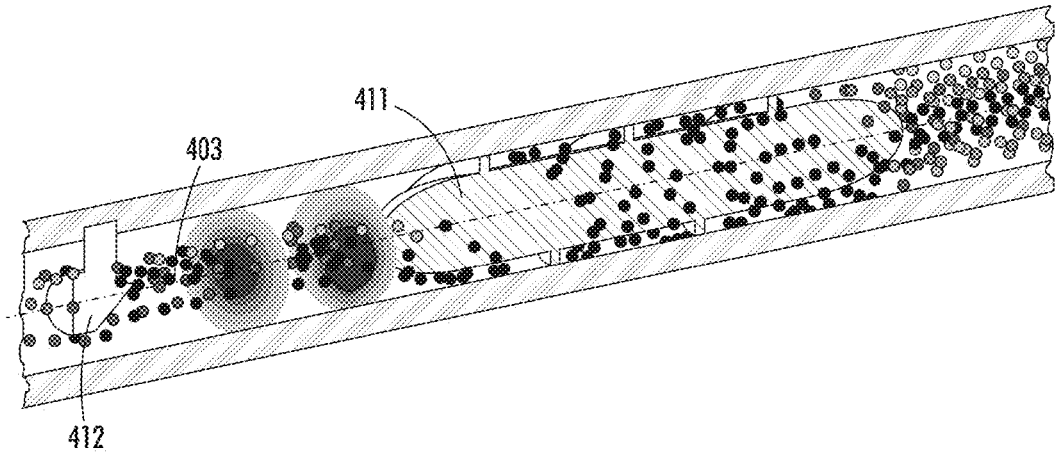
Figure 12:
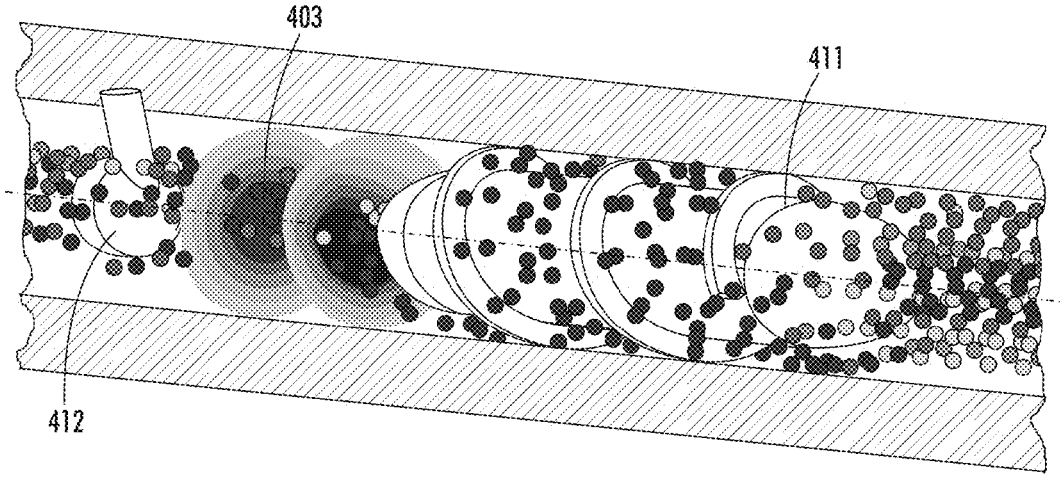

In FIGS. 11 and 12, different views show velocity simulation results for neutrally buoyant bubbles having with the density of saturated nitrogen gas. Bubbles are accelerated, as indicated by the shift to the darker shading of the bubbles, and are focused in the concentrated bubble stream. The concentrated stream of bubbles impacts the bubble extractor 412. The bubbles are inertialess and are shaded according to velocity with lighter shades indicating lower velocities and darker shades indicating higher velocities. Slices show the velocity profile, which the core at roughly 50 cm/second. Notably, the cyclonic generator 411 is effective at focusing the bubbles into the region of the bubble extractor 412. Assuming effective trapping at the bubble extractor 412, the bubble content of the ink flow would be substantially reduced, mitigating printing failure due to bubble clogging.

Figure 13:
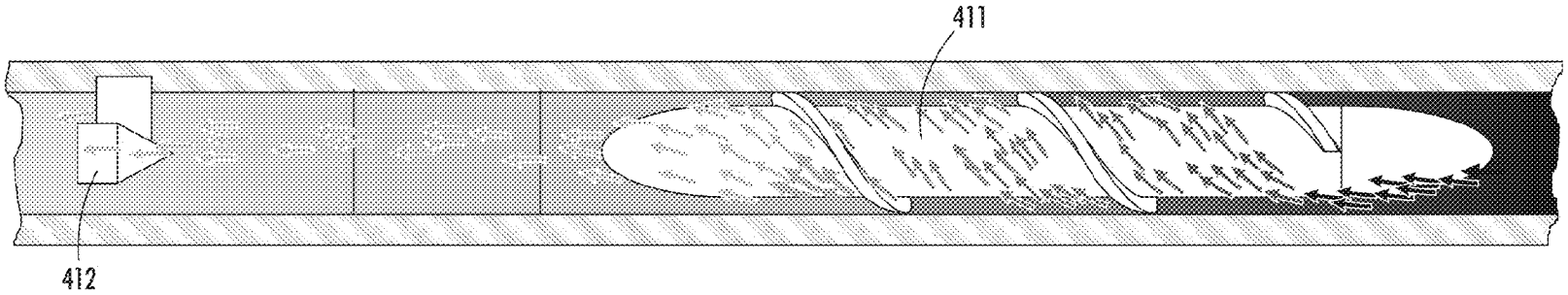

In FIG. 13, slices of the pressure field and velocity vectors are presented. Each turn in the cyclonic generator 411 induces a pressure drop while accelerating the bubbles. It can be seen for this flowrate (1 ml/s) that the pressure drop is roughly 20 kPa, which is largely due to the design of the cyclonic generator 411. Using a larger channel and cyclone generator spacing, pressure drops as low as 1 kPa were obtained but at the cost of less effective bubble focusing. The helix pitch and spacing of the cyclonic generator 411, as well as other separator geometry, may be selected to provide optimal bubble separation performance and the pressure drop.

Figure 14:
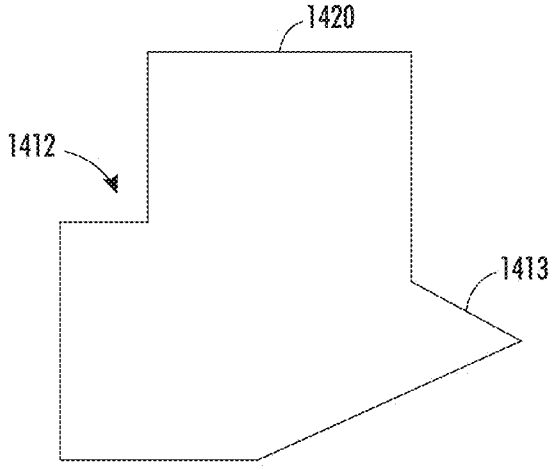
FIGS. 14 and 15 provide cross section and isometric views, respectively, of a bubble extractor in accordance with some embodiments.
Figure 15:
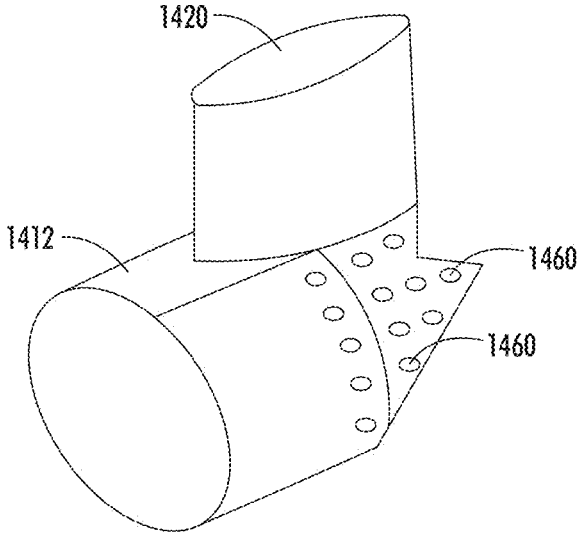

FIGS. 14 and 15 provide cross section and isometric views, respectively, of a bubble extractor 1412 coupled to vapor outlet 1420 in accordance with some embodiments. In some cases, as illustrated by FIGS. 14 and 15, the bubble extractor 1412 may have a conical portion 1413. When positioned within the flow channel, the narrow end of the cone is pointed toward the focusing element, e.g., cyclonic generator. The bubble extractor 1412 presents to the concentrated bubble stream a surface that is configured to a trap substantial number, a majority, or substantial majority of bubbles without causing the bubble separator to produce unacceptable pressure drops. For example, pressure drops of less than 6-12 kPa may be acceptable, e.g., during printer prime and/or purge operations.

Figure 16:
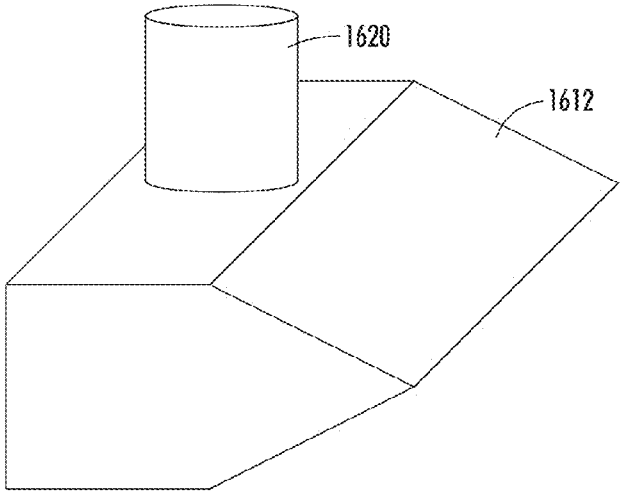
FIGS. 16 and 17 depict various shapes that may be used for a bubble extractor in accordance with various embodiments.
Figure 17:
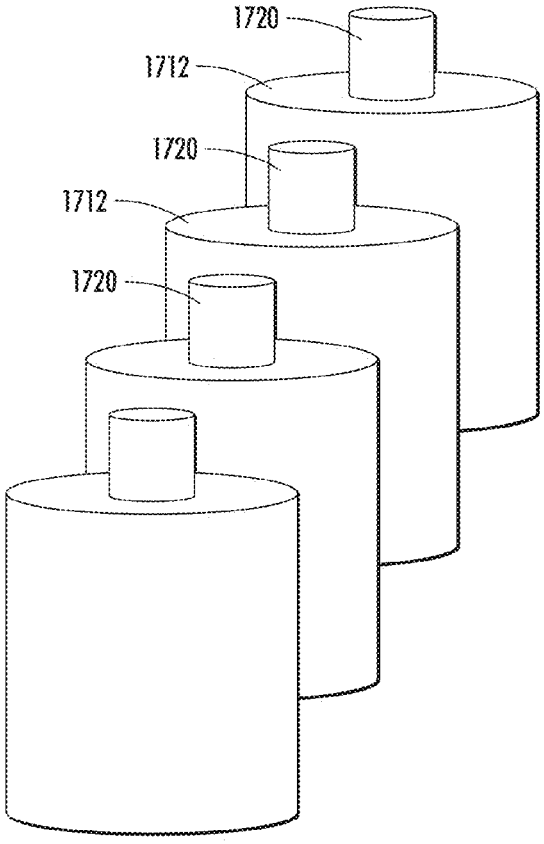

In various configurations, a bubble extractor may comprise one or more bubble trapping elements that have any geometrical shape. For example, the bubble extractor may comprise one or more cones, one or more wedges (1612, FIG. 16), and/or may comprise a series of walls, such as cylindrical walls (1712, FIG. 17). The bubble extractor may comprise a grid of bubble trapping elements and/or any other shaped element or arrangement of elements. One or more of the bubble trapping elements may be coupled to a vapor vent 1620, 1720 configured to vent the trapped bubbles out of the subassembly.

Figure 18:
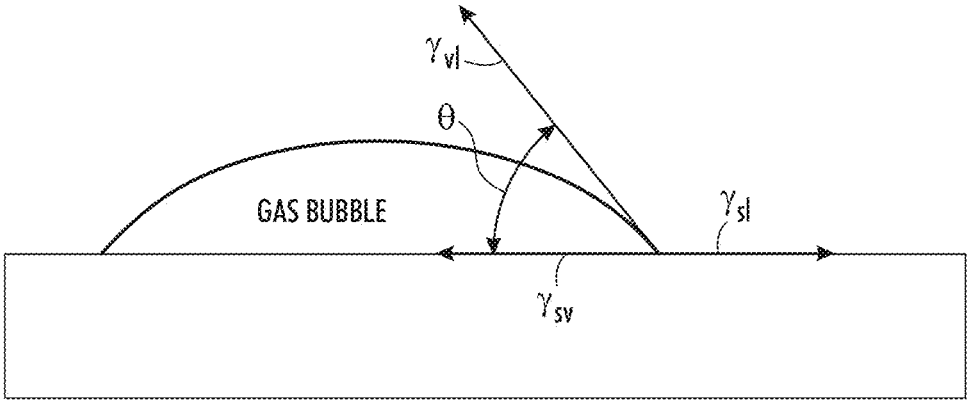
FIG. 18 illustrates the relationship between the surface free energy of the liquid-vapor interface, the surface free energy solid-vapor interface, and the surface free energy of the solid-liquid interface, respectively, and the contact angle.

As illustrated in FIG. 15, at least a portion of the surface of the bubble extractor may include surface features (bubble traps) 1460 that are configured to preferentially trap bubbles while allowing the ink to pass by the features relatively unimpeded. The ability of the surface features 1460 to preferentially trap bubbles may be based on the tendency of a fluidic system to reduce the total surface free energy. The fluidic system comprising bubble rich ink achieves reduced total surface energy when a bubble attaches onto the surface of the bubble trap. Furthermore, the bubble tends to stay in one location to maintain the relatively lower surface free energy. Young's equation provides the relationship between the components of the surface free energy:

$$\gamma_{vl}\cos\theta=\gamma_{sv}-\gamma_{sl},$$

where $\gamma_{vl}$, $\gamma_{sv}$ and $\gamma_{sl}$ are the surface free energy of the liquid-vapor interface, the surface free energy solid-vapor interface, and the surface free energy of the solid-liquid interface, respectively, and $\theta$ is the contact angle as illustrated in FIG. 18. The total surface energy of the system can then be defined as:

$$E=\Sigma A\cdot\gamma=A_{vl}\cdot\gamma_{vl}+A_{sl}\cdot\gamma_{sl}+A_{sv}\cdot\gamma_{sv}$$

where $A_{vl}$, $A_{sl}$, and $A_{sv}$ are the surface areas of the liquid-vapor interface, the solid-liquid interface, and the solid-vapor interface, respectively.

Figure 19:
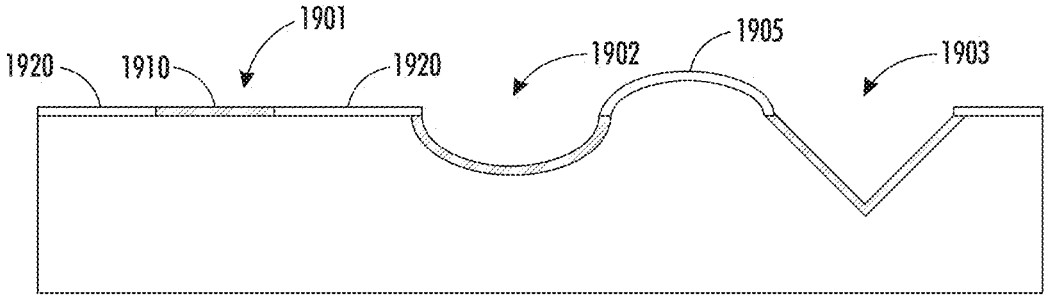
FIG. 19 is a cross section diagram that illustrates a bubble trapping features in accordance with embodiments described herein.

The total surface free energy at a bubble trapping feature on the surface of the bubble trap is minimized when a bubble is attached onto the bubble trapping feature. FIG. 19 illustrates a cross section of a portion of a bubble extractor surface that includes several types of bubble traps. For example, bubble trap 1901 comprises a hydrophobic or superhydrophobic region 1910 which may be adjacent to hydrophilic regions 1920. Bubble traps 1902 and 1903, respectively, comprise concave indentations into the bubble trap surface. Trap 1902 represents an elliptical or spherical indentation and feature 1903 is a conical or wedge-shaped indentation. It can be shown that it is energetically favorable for bubbles to attach to the indentations 1902, 1903 even for contact angles greater than 90°. Optionally, the indentations have a hydrophobic surface. The surface adjacent to and/or between the bubble trapping features may be hydrophilic. In some cases, the surface adjacent and/or between the bubble trapping features may be shaped to repel bubbles, as illustrated by convex protrusion 1905.

The bubble capturing potential, $\Phi_{bc}$, of a bubble trapping feature may be expressed:

$$\Phi_{bc} = -\frac{(E - E_{0})}{L_b^2 \gamma_{vl}} = \gamma_{vl}(A_{vl} + A_{dry}\cos\theta),$$

where $E_0$ is the total surface energy of a three-phase system with a floating bubble, E is the total surface energy of a three-phase system with an attached bubble, $L_b$ is the characteristic length of the bubble, $\gamma_{vl}$ is the surface free energy on vapor-liquid interface, $A_{vl}$ is the area of the vapor-liquid interface, $A_{dry}$ is the area vapor solid interface, and θ is the contact angle. In various embodiments, the configuration and materials selected for the bubble trapping features can provide a bubble capturing potential of the bubble trapping features that is greater than 1 or even greater than 2. It is usually beneficial to bring the bubbles into close proximity with the bubble trapping features. Bringing the bubbles into close proximity with the bubble trapping features can be achieved using a flow focusing element to create the concentrated bubble stream as previously discussed.

Figure 20:
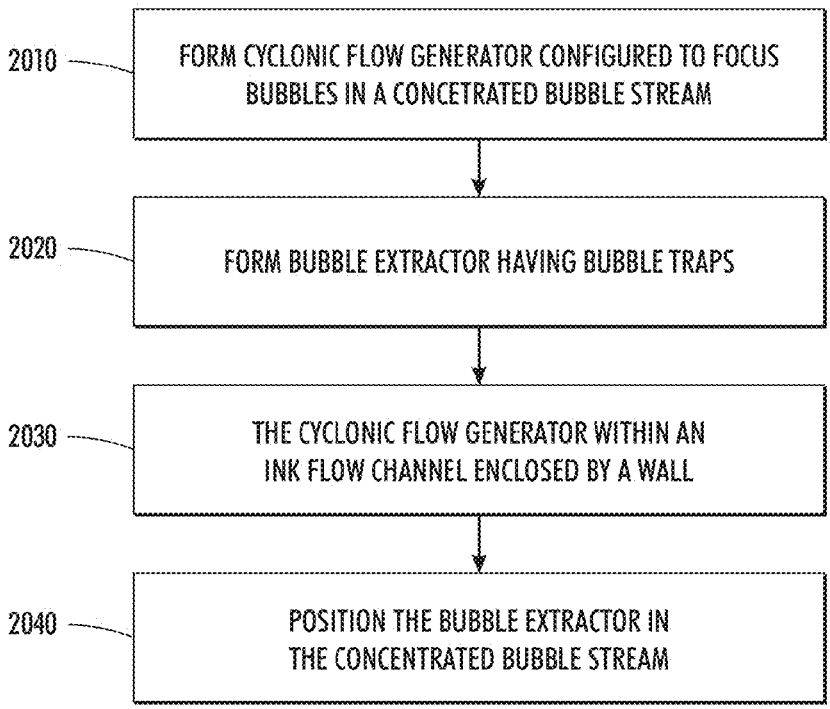
FIG. 20 is a flow diagram of a process of fabricating object separators in accordance with various embodiments.

A process of fabricating a bubble separator is illustrated by the flow diagram of FIG. 20. The process includes forming 2010, 2020 a cyclonic flow generator and a bubble extractor. The cyclonic flow generator is configured to cause a vortex flow of ink containing bubbles and to focus the bubbles into a concentrated bubble stream. The bubble extractor is configured preferentially trap bubbles in one of more bubble traps disposed on the surface of the bubble extractor. The process includes positioning 2030 the cyclonic flow generator in a channel of the ink jet printer subassembly, the channel being enclosed by a channel wall. The bubble extractor is positioned 2040 downstream from the cyclonic flow generator and in the flow path of the concentrated bubble stream.

The bubble separator can be manufactured and incorporated into an inkjet subassembly in a number of ways. The bubble extractor includes a textured surface with altered contact angle properties. The bubble extractor can be made using a number of mechanical and/or coating methodologies, including but not limited to etching, laser cutting or machining, followed or preceded by spin or dip coating, vapor deposition, or plating, depending on the geometric features and surface properties desired. For example, in embodiments that include indented bubble trapping features, the indentations, e.g., conical indentations, may be formed by etching, laser cutting, or machining. After formation of the indentations, the indentations may be coated with a hydrophobic coating by spin coating, dipping, vapor deposition, plating, and/or spraying. The various processes can be used individually or in combination to produce a bubble separator as discussed herein.

The manufacture of the cyclonic flow generator can be accomplished using methods such as, but not limited to, roll coating, micromachining, or molding. The cyclonic flow generator and/or the bubble extractor may be positioned and fixed into the ink flow channel using a variety of bonding methods such as adhesives, soldering, or welding. Alternatively or alternatively, one or more features of the bubble separator could be incorporated into a molded part.

Figure 21:
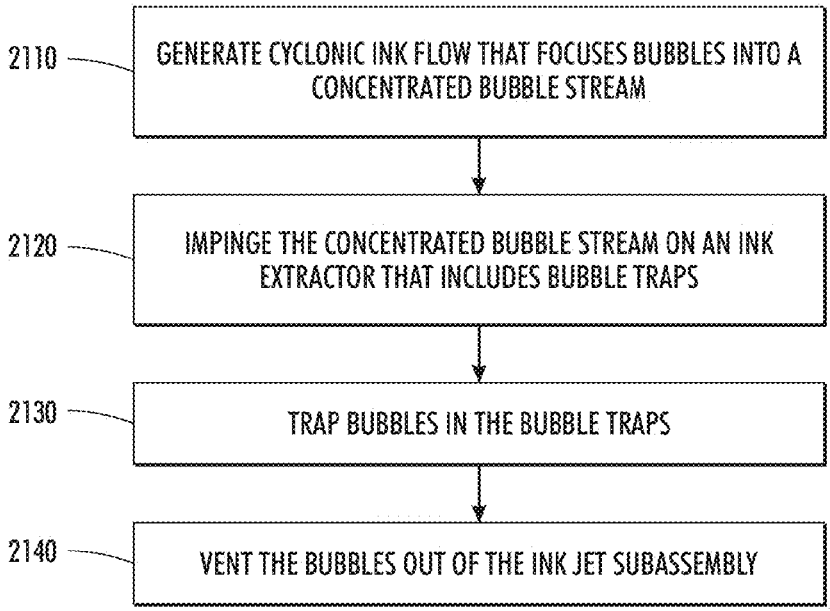
FIG. 21 is a flow diagram that illustrates an object removal process in accordance with embodiments herein.

FIG. 21 is a flow diagram illustrating use of the bubble separator. Ink that includes bubbles flows into a bubble separator where a cyclonic flow generator generates 2110 a vortex ink flow. The vortex flow focuses the bubbles into a concentrated bubble stream. The concentrated bubble stream impinges 2120 on a bubble extractor that has a surface features that provide bubble traps. A substantial number, a majority, or a substantial majority of bubbles present in the concentrated bubble stream, e.g., bubbles having sizes in the 10 μm to 100 μm range, are trapped 2130 in the bubble traps disposed on the surface of the bubble extractor. The trapped bubbles are vented 2140 out of the ink flow path. The ink (minus the bubbles that have been extracted) exits the bubble separator through an ink outlet and may travel through the fluidic circuit of the ink jet printer to the ink injectors where the ink is ejected toward the print medium.

In some implementations, an ink jet subassembly includes an object separator capable of separating bubbles and particles from the ink flow. For example, the object separator may be configured to focus bubbles into focused stream of bubbles and to focus the particles into a focused stream of particles. In some cases, the object separator may comprise a cyclonic generator configured to focus the stream of bubbles to the vortex core while focusing particles to the outside of the channel.

Figure 22:
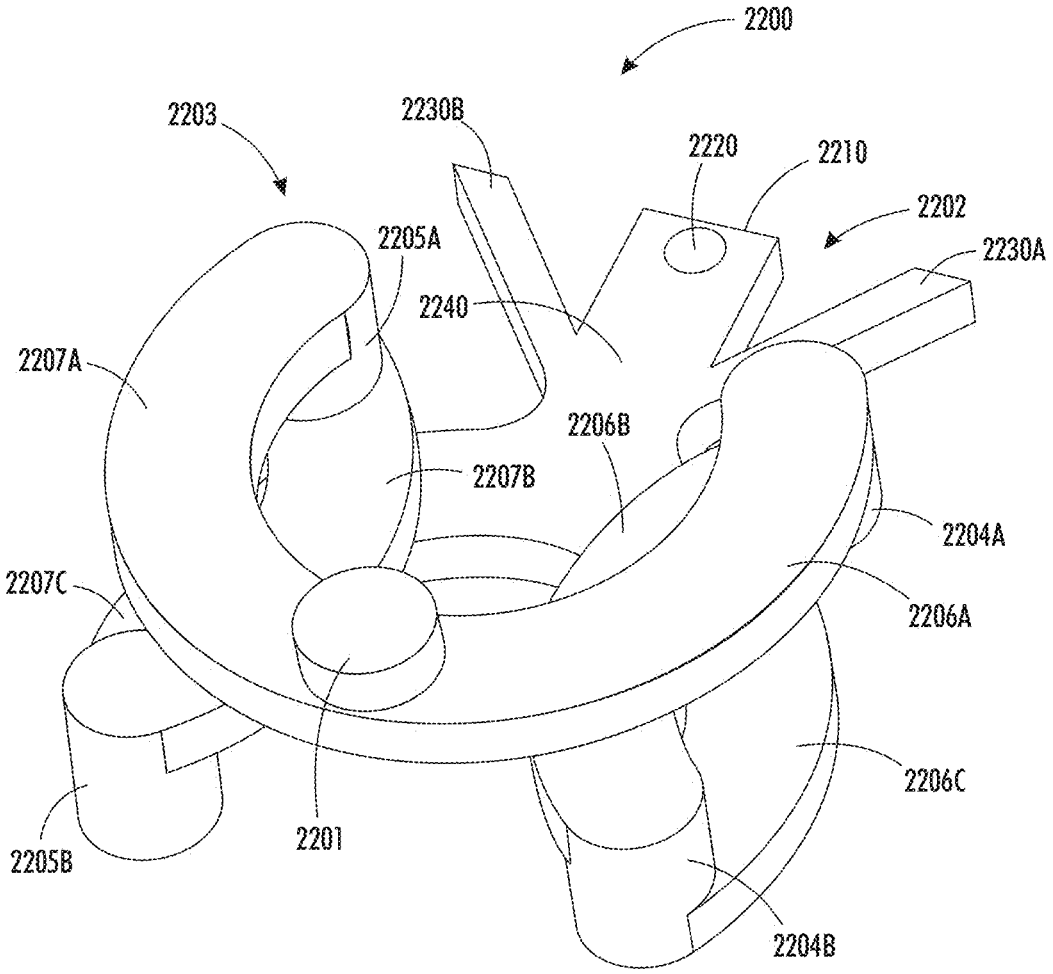
FIG. 22 illustrates a flow path of an object separator formed using a stacked plate architecture in accordance with some embodiments.

FIG. 22 illustrates the flow path of an object separator 2200 according to some embodiments. This embodiment involves two cyclonic generators that create parallel opposing vortex flows. However, in other embodiments, the object separator may generate a single vortex flow or may generate multiple serial vortex flows within the ink flow path. Ink, having particles and/or bubbles, flows into the object separator through an inlet 2201. The ink having bubbles and particles flows along two opposing cyclonic flow paths 2202, 2203. The cyclonic flow paths 2202, 2203 include multiple curved sections 2206*a-c*, 2207*a-c* connected by vias 2204*a-b*, 2205*a-b*. The curved sections 2206*a-c* and vias 2204*a-b* of flow path 2202 creates a first vortex flow. The curved sections 2207*a-c* and vias 2205*a-b* of flow path 2203 creates a second vortex flow that opposing the first vortex flow. Each of the vortex flows created by flow paths 2202, 2203 focuses bubbles in the flow path to the center of the vortex flows at flow path section 2240. Bubbles in the focused bubble stream are extracted through a vent 2220. The object separator may include a bubble trap in the flow path 2200 near the vent 2220 configured to trap bubbles for extraction from the flow path 2200.

The particles traveling along flow path 2202 are focused toward the edges of the vortex stream created by flow path 2202. The particles exit the ink flow path through particle outlet 2230*a*. These particles traveling along flow path 2203 are focused toward the edges of the vortex stream created by flow path 2203. These particles exit the ink flow path through particle outlet 2230*b*. The ink, having a majority of the bubbles and particles removed, flows out of the flow path 2200 of the object separator along path 2210.

Figure 23:
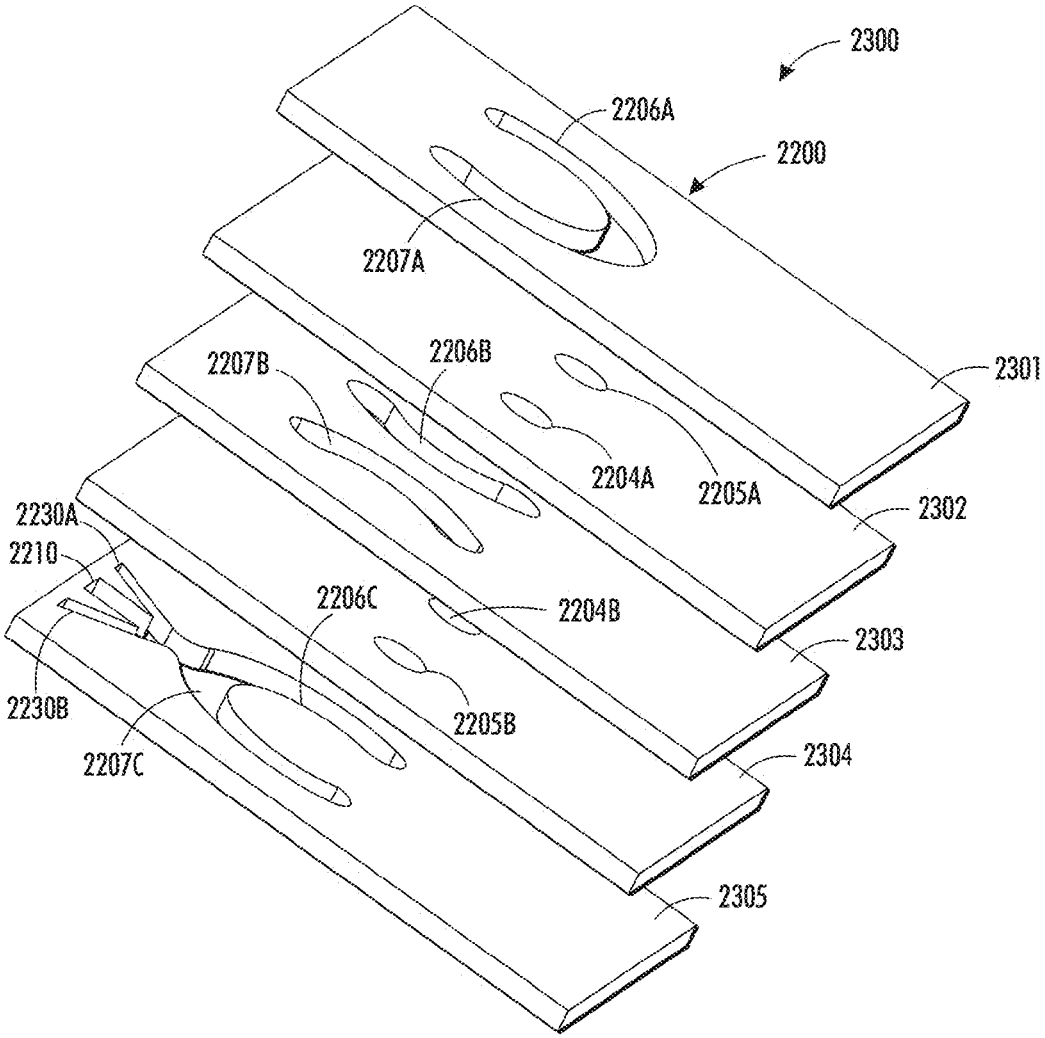
FIG. 23 shows a series of plates that can be used to the create flow path of FIG. 22.

The flow path 2200 of FIG. 22 can be formed by an object separator comprising a number of stacked plates. FIG. 23 illustrates an object separator 2300 comprising a series of plates 2301-2305 that can be used to create flow path 2200. Corresponding flow path features illustrated in FIG. 22 are indicated by the same reference numbers in FIG. 23. The object separator 2300 exploits recirculation flows in curved channels 2206*a-c*, 2207*a-c* in the plates 2303, 2305 and bends through vias 2204*a-b*, 2205*a-b* in plates 2304, 2302. Vias 2204*a*, 2205*a* are included in plate 2202 which is disposed between plates 2301 and 2302.

Vias 2204*b*, 2205*b* are included in plate 2304 which is disposed between plates 2303 and 2305 and 2305. The vias 2204*a-b*, 2205*a-b* create bends, e.g., 90 degree bends. Object separator 2300 also includes curved channels 2206*a-c*, 2207*a-c* that utilize centrifugal force and/or instability to amplify the bend-induced secondary flows to focus particles and/or bubbles. Particles generally focus to outside of channel and bubbles focus to the vortex core.

Stacked plate object separators, such as the object separator 2300 shown in FIG. 23, are compatible with printer architectures that use stacked plates. Additionally, the object separator 2300 utilizes minimal "waterfront" or footprint within the printer flow path. Each plate in the object separator 2300 can be customized to "tune" separation for certain particle or bubble sizes, and exit channels. The number of plates can be varied to accomplish multiple bubble and/or particle separations Some embodiments include bubble traps and/or bubble vents which are integrated into more than one plane/plate. For example, bubble traps and/or bubble vents can be included in each plane/plate. Similarly, particle outlets may be included in multiple plates of the object separator.

Figure 24:
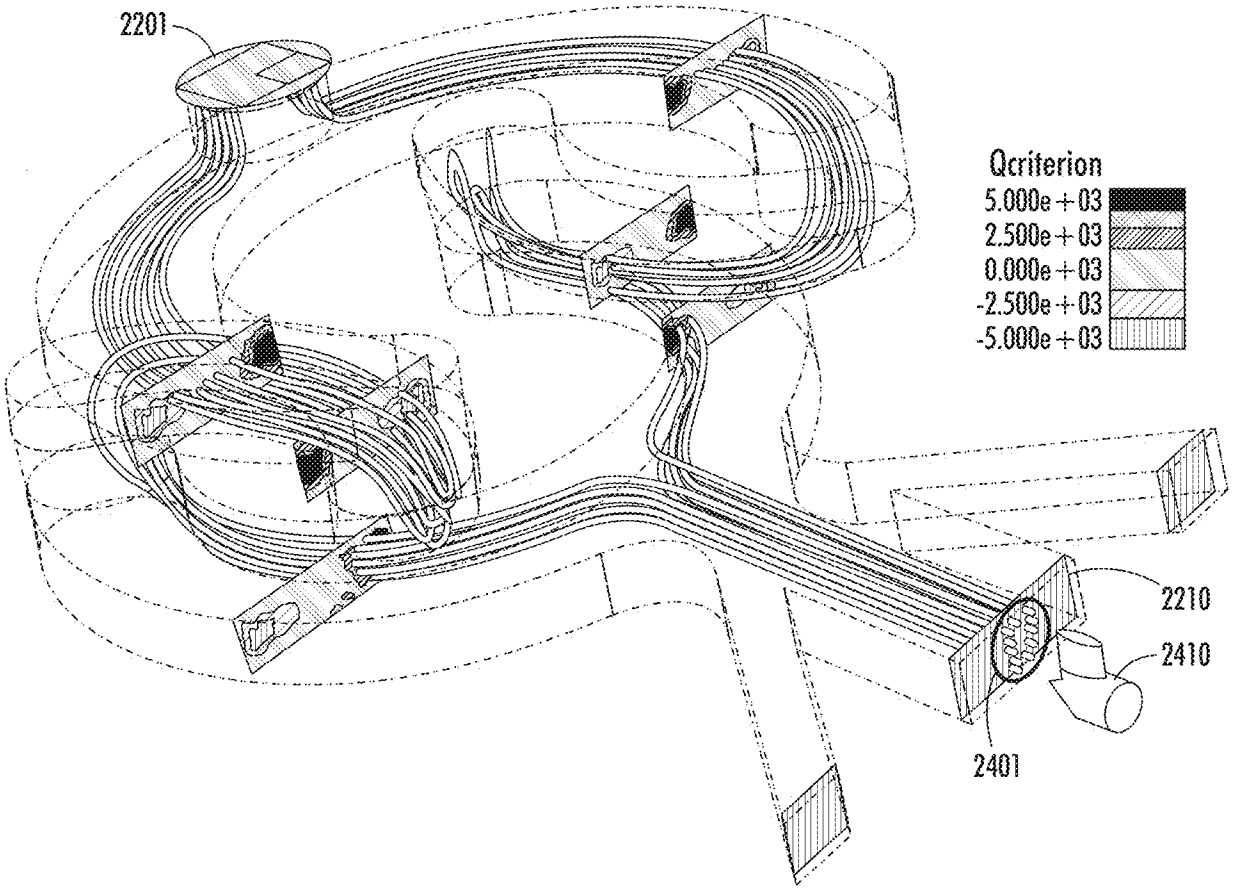
FIGS. 24-27 provide results of computational fluid dynamics (CFD) modeling of the object separator shown in FIGS. 22 and 23.

FIG. 24 illustrates the results of computational fluid dynamics (CFD) modeling of the object separator shown in FIGS. 22 and 23. In this model, a set of traces for massless particles (representing bubbles) is shown to focus the flow stream of bubbles from the outside edge of the inlet 2201 to a focused stream 2401 near the center of the main outlet 2210. A bubble trapping feature 2410, e.g., as previously discussed in connection with FIGS. 14-19 could be located in the flow path of the focused bubble stream 2401.

The different shading in FIG. 24 indicates the variation in the kinematic parameter designated the Q-criterion within the flow path. The Q criterion is the second invariant of the velocity gradient tensor and defines the balance between the rotation rate and the strain rate in the flow. Positive Q isosurfaces (as indicated in FIGS. 24, 26, and 27) define regions where rotation is greater than strain and therefore represent the regions where a vortex resides.

Figure 25:
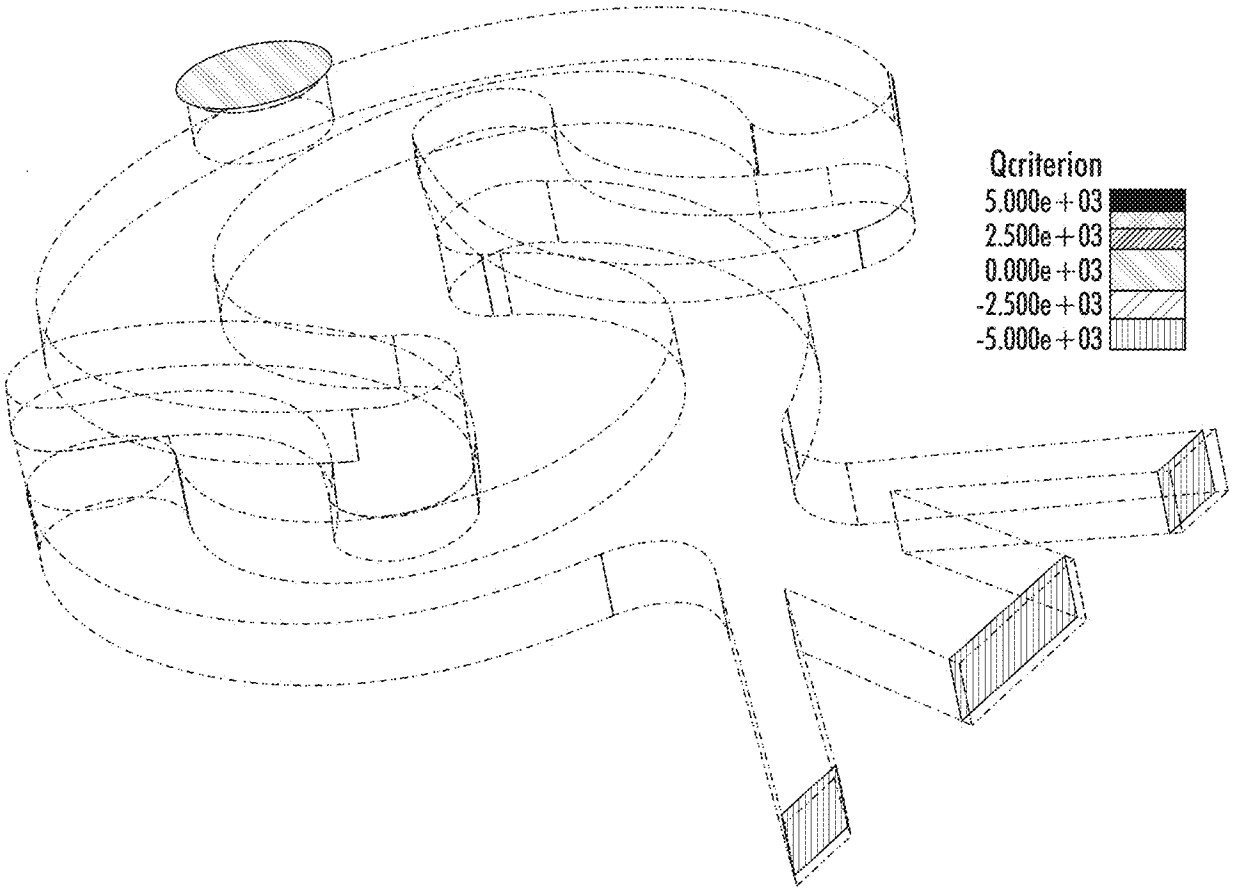

FIG. 25 illustrates the CFD modeling results for pressure drops within the flow path created by the object separator of FIGS. 22 and 23. Pressure drop for this configuration is modest, e.g. less than 1 kPa (0.01 psi) at higher purge flow rates. At lower operational flow rates, the pressure drop would be well within pressure budget of 10-100's of Pa.

Figure 26:
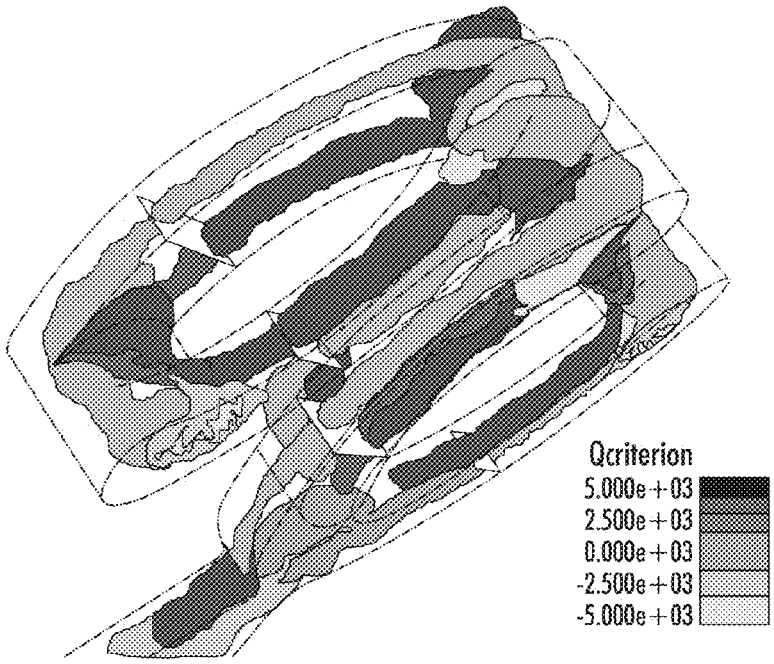
Figure 27:
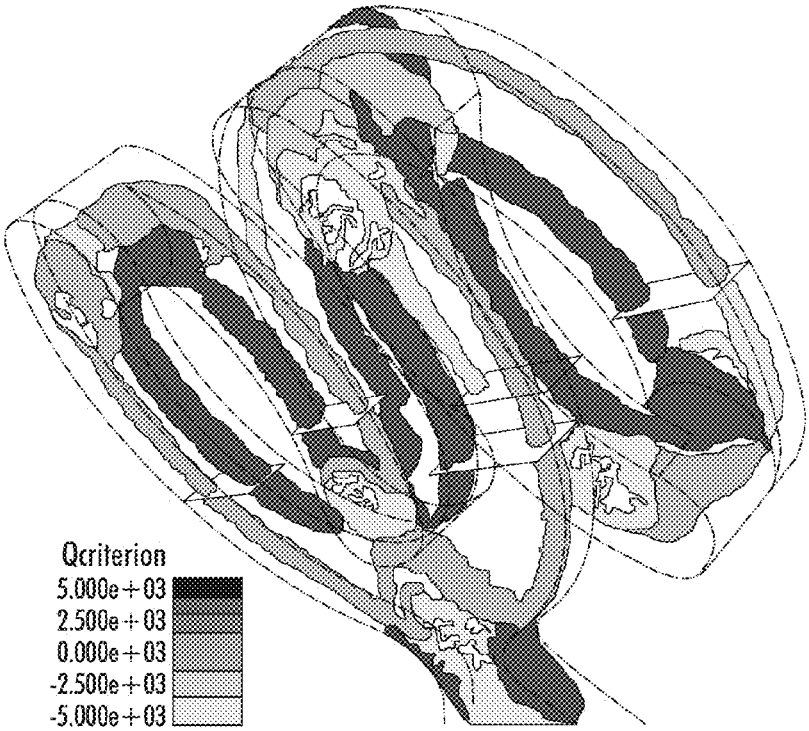

FIGS. 26 and 27 show the opposing vortex cores with shading indicating the value of the Q criterion. The opposing pair of vortex cores quickly form at the inlet bend and stably propagate through structure because of curved channels.

Systems, devices or methods disclosed herein may include one or more of the features, structures, methods, or combinations thereof described herein. For example, a device or method may be implemented to include one or more of the features and/or processes described below. It is intended that such device or method need not include all of the features and/or processes described herein, but may be implemented to include selected features and/or processes that provide useful structures and/or functionality.

Various modifications and additions can be made to the preferred embodiments discussed above. Accordingly, the scope of the present invention should not be limited by the particular embodiments described above, but should be defined only by the claims set forth below and equivalents thereof.

What is claimed is:

1. An ink jet printer subassembly comprising:

an object separator comprising:

one or more inlets configured to allow passage of ink that includes objects into the object separator, the objects comprising one or both of bubbles and particles;

a plurality of stacked plates, at least some of the plates having channels arranged to form at least one cyclonic flow generator, the cyclonic flow generator configured to focus the objects into one or more focused flow streams;

one or more object outlets configured to allow objects to exit the object separator; and at least one ink outlet configured to allow the ink to exit the object separator.

2. The subassembly of claim 1, wherein:

the objects include both particles and bubbles;

the cyclonic flow generator is configured to focus the bubbles into one or more focused bubble streams and to focus the particles into one or more focused particle streams; and the one or more object outlets comprise:

one or more vapor outlets configured to allow the bubbles in the one or more focused bubble stream to exit the object separator; and one or more particle outlets configured to allow the particles in the one or more focused particle streams to exit the object separator.

3. The subassembly of claim 2, further comprising first plates having curved flow channels arranged in a plane of the plates, wherein the one or more focused particle streams focus to outside of the curved flow channels.

4. The subassembly of claim 2, wherein the one or more focused bubble streams focus to a vortex core.

5. The subassembly of claim 2, wherein the one or more focused bubble streams focus to near the center of the one or more object outlets.

6. The subassembly of claim 1, wherein the at least one cyclonic flow generator comprises two cyclonic flow generators, a first cyclonic flow generator configured to produce a first vortex flow path and a second cyclonic flow generator configured to produce a second vortex flow path that opposes the first vortex flow path.

7. The subassembly of claim 1, wherein the plurality of stacked plates comprises:

first plates having curved flow channels arranged in a plane of the plates; and second plates having vias, each second plate arranged between two first plates, the vias fluidically connecting the curved flow channels of the first plates.

8. The subassembly of claim 7, wherein the one or more flow streams have recirculation flows in the curved flow channels and bend through the vias.

9. The subassembly of claim 8, wherein the vias create a 90° bend in the one or more flow streams.

10. The subassembly of claim 7, wherein the curved flow channels are configured to utilize centrifugal force and/or instability to amplify bend-induced secondary flows to focus one or both of bubbles and particles.

11. The subassembly of claim 1, further comprising one or more bubble extractors respectively disposed in the one or more focused object streams, the one or more bubble extractors having bubble traps disposed on a surface of the one or more bubble extractors.

12. The subassembly of claim 11, wherein the bubble extractor comprises one or more bubble trapping features having a bubble capture potential, $\Phi_{bc}$, greater than 1.

13. The subassembly of claim 11, wherein the bubble extractor includes one or more bubble trapping features comprising indentations in a surface of the bubble extractor.

14. The subassembly of claim 13, wherein the indentations are conical or wedge-shaped.

15. The subassembly of claim 13, wherein the indentations have dimensions less than about 30 μm.

16. The subassembly of claim 13, wherein the bubble trapping features are disposed between bubble repelling features.

17. The subassembly of claim 13, wherein the bubble trapping features comprise one or more of hydrophobic or superhydrophobic areas.

18. The subassembly of claim 17, wherein the hydrophobic or superhydrophobic areas are disposed between hydrophilic areas.

19. The subassembly of claim 1, wherein the plurality of stacked plates can be varied to accomplish at least one of separation for certain particle or bubble sizes and multiple bubble and/or particle separations.

20. A method of making an object remover for an ink jet printer comprising:

forming first plates that include in-plane curved channels;

forming second plates that include vias; and arranging the plates in a stack so that the curved channels and vias form a cyclonic flow path.

21. An ink jet printer subassembly comprising:

an object separator comprising:

one or more inlets configured to allow passage of ink that includes objects into the object separator, the objects comprising one or both of bubbles and particles;

a plurality of stacked plates, at least some of the plates having channels arranged to form at least one cyclonic flow generator, the cyclonic flow generator configured to focus the objects into one or more focused flow streams, wherein the plurality of stacked plates comprise:

first plates having curved flow channels arranged in a plane of the plates; and second plates having vias, each second plate arranged between two first plates, the vias fluidically connecting the curved flow channels of the first plates;

one or more object outlets configured to allow objects to exit the object separator; and at least one ink outlet configured to allow the ink to exit the object separator.

22. The subassembly of claim 21, wherein the one or more flow streams have recirculation flows in the curved flow channels and bend through the vias.

23. The subassembly of claim 22, wherein the vias create a 90° bend in the one or more flow streams.

24. The subassembly of claim 21, wherein the curved flow channels are configured to utilize centrifugal force and/or instability to amplify bend-induced secondary flows to focus one or both of bubbles and particles.

* * * * *